United States Patent [19]

Fotheringham et al.

[11] Patent Number: 4,966,020

[45] Date of Patent: Oct. 30, 1990

[54] LOCKING MECHANISM

[75] Inventors: Scott M. Fotheringham; Robin H. Fotheringham, both of Mississauga, Canada

[73] Assignee: 880335 Ontario Inc., Niagara Falls, Canada

[21] Appl. No.: 362,309

[22] Filed: Jun. 6, 1989

[51] Int. Cl.[5] ..... E05B 47/00

[52] U.S. Cl. ..... 70/276; 70/58; 70/63

[58] Field of Search ..... 70/276, 57, 58, 63, 70/85, 86; 292/251.5

[56] References Cited

U.S. PATENT DOCUMENTS

| | | | |
|---|---|---|---|
| 511,167 | 12/1893 | Shaffer et al. | 70/276 |
| 767,298 | 8/1904 | Louis | 70/276 X |
| 2,090,302 | 8/1937 | Montgomery et al. | 70/276 X |
| 2,722,821 | 11/1955 | Atkins | 70/276 X |
| 2,730,392 | 1/1956 | Thiebaud | 70/276 X |
| 3,744,833 | 7/1973 | Berducone | 70/276 X |
| 3,831,986 | 8/1974 | Kobayashi | 70/276 X |
| 3,837,195 | 9/1974 | Pelto | 70/276 |
| 3,837,525 | 9/1974 | Kobayashi | 70/276 X |
| 3,855,827 | 12/1974 | Hallman et al. | 70/276 X |
| 4,172,624 | 10/1979 | Swain | 70/86 X |
| 4,216,857 | 8/1980 | Huang | 70/63 X |
| 4,325,531 | 4/1982 | Omholt | 70/63 X |
| 4,469,225 | 9/1984 | Takahashi | 70/63 X |
| 4,854,145 | 8/1989 | Arai et al. | 70/58 X |

*Primary Examiner*—Robert L. Wolfe
*Assistant Examiner*—Suzanne L. Dino
*Attorney, Agent, or Firm*—Carson, Armstrong

[57] ABSTRACT

A novel locking mechanism and specific applications for same are disclosed. One aspect of the invention provides a product security system having a locking mechanism for preventing sliding movement between a slidably juxtaposed product container and product container locking structure, and a separate decoupling unit. The decoupling unit has a frame adapted to receive the slideably juxtaposed parts, and means within the frame adapted to disengage the locking mechanism, thereby permitting sliding decoupling of the parts. The locking mechanism has a magnetically attractable pin in a blind hole in the first part and a detent opening or recess in the second part. The pin is moveable between a first position in which the pin enters the detent, thereby preventing sliding movement between the first and second parts, and a second position in which the pin is retracted into the blind hole from the detent, thereby permitting sliding movement. Means are provided for biasing the pin into the first position. One particular embodiment of the invention is a locking kit for a box having a hinged lid, such as a video cassette box.

15 Claims, 3 Drawing Sheets

LOCKING MECHANISM

BACKGROUND OF THE INVENTION

This invention relates to a locking mechanism, with particular applications in security systems and merchandising display systems for the retail industry.

The usual security practice in the sale of small items is to keep the products in a single large display unit and to allow access to these products only under the watchful eye of the sales staff. This approach is typical of jewellery stores where due to the high cost of each unit it is economically feasible to maintain a one to one sales staff/customer ratio.

In retail establishments that sell large volumes of relatively inexpensive goods the typical modern security system is multifaceted. Magnetic strips or similar electronic theft alarm activators or "tags" are attached to the items of merchandise. The activators will set off an alarm upon passage through a detection apparatus placed at the store exits if they are not deactivated by a suitable apparatus operated by a store employee prior to the passage of the "tagged" item through the system.

These multifaceted security systems are plagued with a number of problems. There are three ways to circumvent the activation of the detection system, the first being to pass the tagged article around the detection system so that it does not pass through the sensing field. The second way is to deactivate the activator or tag with a suitable apparatus prior to entry into the sensing field. The third is to remove the activator or tag from the item or to damage it so it will not accomplish its function.

Alternatively, the packaging to which a strip is attached can be removed in its entirety. For example, one popular way of stealing video cassettes is by removing them from the packaging and pocketing the cassettes and walking out of the store.

The activators or tags leave the store with the customer and thus are a significant cost of operating the electronic security system. In addition, trained staff often posing as customers and backed up by mirrors and video cameras are often required in order to attempt to monitor the shoppers and thereby detect attempts to overcome the theft-detection system.

Security personnel and the equipment they require are unfortunately expensive and far from foolproof.

Due to the high cost of operating a multifaceted theft detection system some stores have restricted access to their merchandise. For example, some video cassette stores display only the empty video cassette art work boxes. If the clients wish to purchase or rent a video cassette, they bring the empty box to the cash register where they are provided with another box containing the desired cassette.

SUMMARY OF THE INVENTION

It is an object of the invention to overcome or mitigate some of the disadvantages and inconveniences of the prior art, by providing a novel locking mechanism and specific applications for same.

In preferred embodiments, the invention provides for close examination of high-priced articles without the need for a one-to-one sales staff/customer ratio, standardizes the mass merchandising display of items, prevents the removal of electronic theft alarm activators by thieves, protects the items from damage, and permits recycling of the activators since they do not leave the store with the purchased merchandise.

Thus in accordance with one aspect of the invention there is provided a product security system having a locking mechanism for preventing sliding movement between a slidably juxtaposed product container and product container locking structure, and a separate decoupling unit. The decoupling unit has a frame adapted to receive the slideably juxtaposed parts, and means within the frame adapted to disengage the locking mechanism, thereby permitting sliding decoupling of the parts.

In another aspect, there is provided a keyless locking mechanism for preventing sliding movements between first and second slidably juxtaposed parts. The locking mechanism has a magnetically attractable pin in a blind hole in the first part and a detent opening or recess in the second part. The pin is moveable between a first position in which the pin enters the detent, thereby preventing sliding movement between the first and second parts, and a second position in which the pin is retracted into the blind hole from the detent, thereby permitting sliding movement. Means are provided for biasing the pin into the first position.

One particular embodiment of the invention is a locking kit for a box having a hinged lid. The kit includes a anchoring track strip fastenable along at least a portion of the sidewall of the box remote from the hinge, and a locking chamber slidably engageable with the anchoring track strip. The locking chamber includes a flange adapted to overlie at least a portion of the lid, thereby preventing it from being opened.

An electronic theft alarm activator or tag preferably is permanently inserted into the interior of the locking chamber. A price tag and a price code or the like may be attached to the exterior of the locking chamber.

A second embodiment is a lockable display box. The box has an open top. A locking unit is fastened to one end of the box, the locking unit including at least one pin moveable between a first position in which the pin enters the detent, thereby preventing sliding movement between the first and second parts, and a second position in which the pin is retracted into the blind hole from the detent, thereby permitting sliding movement A sleeve is slidable over the box to cover the open top, the sleeve including structural means which contact the underside of the box such that the sleeve can only be applied and removed by sliding in the plane of the box, the sleeve including detent recesses.

An electronic theft alarm activator is preferably attached to the interior of the lockable display box. Advertising material, a price tag and a price code may be attached to the interior or exterior of the box.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
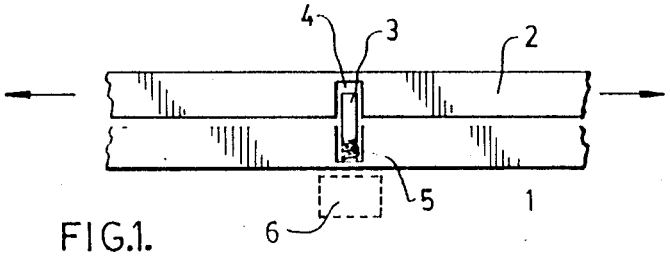
FIG. 1 is a sketch illustrating the principle of the locking mechanism.

FIG. 1 illustrates the general principle of the invention. A first part 1 is slidably engageable with a second part 2. The locking mechanism prevents the sliding movement by providing a pin 3 in the first part moveable in and out of a hole, slot, or other detent 4 in the second part and biased into the hole, slot or other detent, e.g. by a spring 5, or for example by a magnet. The locking mechanism is disengaged by positioning a strong magnet 6 to pull the pin back from the second part into the first part, and then sliding the parts relative to each other to decouple them. Either the pin itself is ferrous or otherwise magnetically attractable, or the pin is mounted on or connected to a ferrous or otherwise magnetically attractable part.

This principle can be employed in a variety of embodiments, two of which are described in detail below. In the first described embodiment, the principle is used to lock a box having a hinged lid, e.g. a common video cassette box. In the second described embodiment, the principle is used to lock a display box or the like, which could contain, for example, a compact disc (CD), audio cassettes, a watch or watches, jewellery, or other hand-held consumer goods or items.

Figure 2:
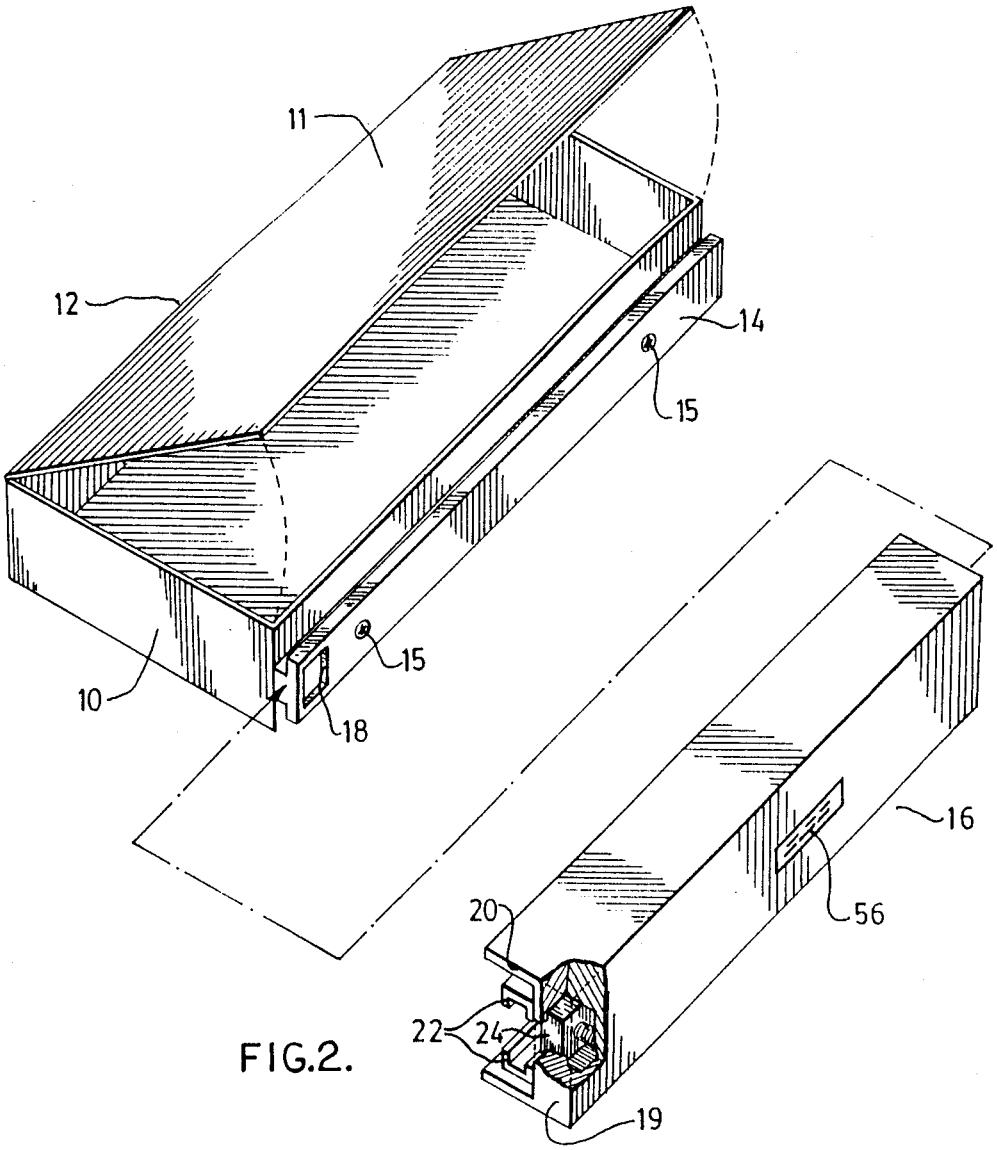
FIG. 2 is an exploded perspective, showing a video cassette box and the video cassette box locking structure.

The video cassette box embodiment is illustrated in FIG. 2. The video cassette box 10 has a lid 11 hinged along edge 12. The locking system has two main components, namely an anchoring track strip 14 and a locking chamber 16.

The anchoring track strip 14 is a strip of plastic or other suitable material with a T-shaped cross-section, extending continuously along the edge of the video cassette box, or broken by a space. It is permanently attached, for example by screws 15, to the exterior of the video cassette box sidewall remote from the hinged edge 12. Alternatively, it could be attached by a suitable adhesive, or could be moulded integrally with the video cassette box. Locking pin detent holes 18 are provided at any convenient location.

Figure 3:
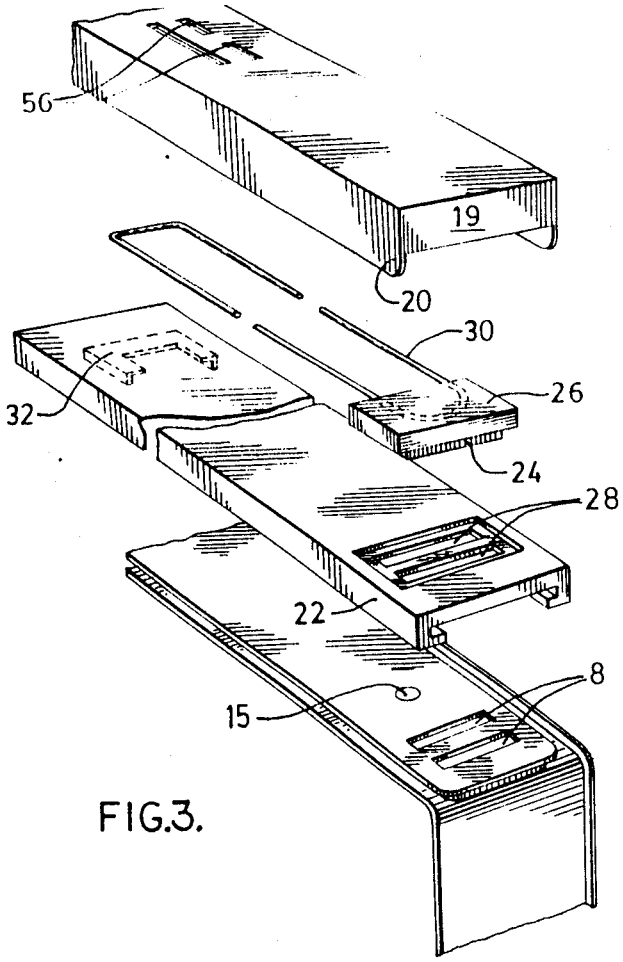
FIG. 3 is an exploded perspective of the video cassette box locking structure.

In the preferred version of this embodiment, the locking chamber is constructed as shown in FIG. 3. It has a main body portion 19 which includes a flange 20 adapted to overlie the video cassette box lid 11. Fastened to the inner side of the main body is a locking channel 22 having a C-shaped vertical transverse cross section adapted to engage the anchoring track strip 14. At a location corresponding to the location of the detent holes 18 on the anchoring track strip 14 are locking pins 24 corresponding dimensionally to the detent holes. The locking pins 24 project from a locking pin holder 26 through holes 28 in the locking channel, and are biased towards the anchoring track strip by a metal spring 30 positioned in a spring holder 32 on the locking channel. Either they are ferrous or otherwise magnetically attractable, or they or mounted on or connected to a ferrous or otherwise magnetically attractable part.

In order to secure the lid 11 of the video cassette box, the locking chamber 16 is slid onto the anchoring track strip 14 until the detent holes 18 and the locking pins 24 come into alignment. The locking pins then pop into place in the detent holes due to the force exerted by the spring 30. The video cassette box then cannot be opened, because the flange 20 overlies the lid 11.

Figure 4:
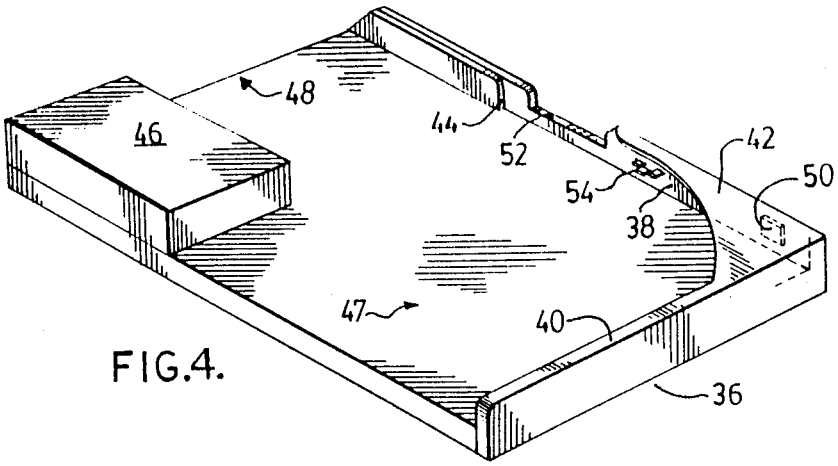
FIG. 4 is a perspective of the video cassette box locking mechanism decoupler.
Figure 5:
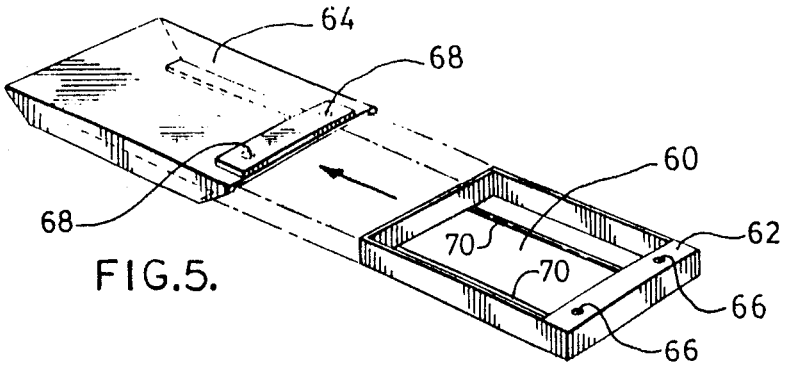
FIG. 5 is a perspective showing a lockable box consisting of a tray which is lockable within a sleeve.
Figure 6:
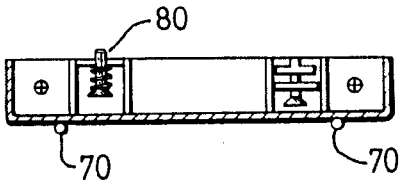
FIG. 6 is an end view of the locking unit for the lockable box.
Figure 7:
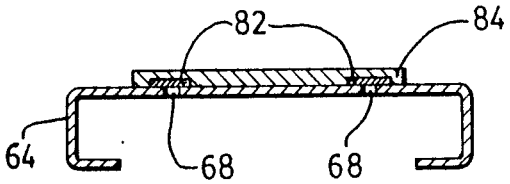
FIG. 7 is an end view of the sleeve.

The decoupler or release unit 36 is illustrated in FIG. 4. It is basically a rectangular platform. Along one edge there is a longitudinal wall 38 of height approximately equal to the height of a video cassette box. Adjacent to one end of the longitudinal wall is a short transverse wall 40. An optional cover 42 caps the corner at the junction of the longitudinal wall and the transverse wall. At the rear end of the wall 38 is a locking chamber stop 44 jutting inwardly from the longitudinal wall. A block 46 is positioned in the corner diagonally opposite the cover. The block defines a video cassette box entry area 47 between the block and the transverse wall, and an exit area 48 between the block and the longitudinal wall. A strong magnet 50 is located underneath the cover on the interior surface of the longitudinal wall.

In order to detach the locking chamber from the video cassette box, the locked video cassette box is slipped into the decoupler 36 at the entry area 47, until the locking chamber 16 abuts the interior of the longitudinal wall. In this position the locking pins 24 are exactly aligned with the magnet 50. The magnet acts against the force of the metal spring 30 to withdraw the locking pins from the detent holes 18. The video cassette box can now be removed from both the decoupler and the locking chamber through the exit area 48. The locking chamber remains in the decoupler because it is stopped by the locking chamber stop 44. After the video cassette box is removed, the locking chamber can be dislodged from its position against the locking chamber stop 44 with a flick of the thumb. To facilitate this, a thumb recess 52 is cut into the wall 38.

An optional feature of this embodiment is a metal key 54 which protrudes from the interior of the wall 38. A corresponding fake key hole 56 in the exterior longitudinal side of the locking chamber's main body 19 is dimensioned to mate with the key. The function of the key is to lessen the chance that potential thieves will understand the true mode of operation of the locking mechanism, by misleading them into thinking that it is the key which unlocks the mechanism.

An optional feature of this embodiment is to construct the video exit 48 such that its surface slopes upwardly at an angle of 5 to 10 degrees from the plane of platform. The canting of the surface allows for the gravitational applied friction to assist and to facilitate the video cassette box removal, and provides sufficient space for the operator's fingers to pick up the video cassette box at the exit area 48.

To use the system, an anchoring track strip is permanently installed on each video cassette box, and a locking chamber is temporarily positioned on each one. The locking chamber includes a slot in the opposite end to the locking pin placement so that a conventional security system activator or tag can be inserted permanently into the locking chamber. The locking chamber can only be removed at the cash register or sales desk, where the decoupler is kept.

Referring now to FIGS. 5–8, the second embodiment to be described herein is a "security box" for small objects such as compact discs (CDs), cassettes, watches, jewellery, or any hand-held consumer goods or items. The unit includes a tray 60, correspondingly sized to receive the item to be displayed, a locking unit 62 mounted on or integral with an end of the tray, and a rigid transparent sleeve 64 into which the tray fits, with the locking unit having locking pins 66 which engage detent holes 68.

The tray 60 is a rectangular open-topped container of clear acrylic or other suitable transparent material. In the preferred embodiment, the side of the sleeve wrap around only partially underneath the tray. In the open portion of the bottom, adjacent the edges of the portions which wrap around, for greater rigidity and to lessen friction in sliding in and out of the sleeve, the tray has two sliders 70 on its underside, parallel and adjacent to its longitudinal edges. The sliders extend down below the plane of the bottom surface of the sleeve, so that they rather than the sleeve are in contact with whatever surface the security box is on.

The locking unit 62 in this embodiment is a rectangular box with length equal to that of the end wall of the tray 60. . The locking unit is integrally molded with an end wall of the tray, or is permanently attached by an adhesive or other means to the end wall of the tray.

Two vertically positioned ferrous screws 80 span the height of the locking unit. The top portion of each screw is capped with a locking pin holder and bevelled roundstock which together constitute a locking pin 66. The screws are moveable in the vertical direction so that the locking pins can be positioned to protrude above the top surface of the locking unit through holes 67 cut into the top surface of the locking unit 62.

The sleeve 64 is made of a single piece of clear acrylic or similar suitable transparent material. Two detent holes 68 at one end of the top of the sleeve are provided to accommodate the locking pins 66. The holes are overlaid by a plastic strip 84. To lock the box, the tray is inserted into the sleeve until the locking pins align with the detent holes. Springs positioned one each around each screw 80 compress when the locking pins are depressed by the action of the leading edge of the sleeve passing over them. As the detent holes come into alignment with the locking pins, the springs return to their original form and force the locking pins into the detent holes 68, thereby locking the box.

A second way of achieving the vertical movement of the locking pins is to have two vertically positioned ferrous or other magnetically attractable rods span most of the height of the locking unit. The detent holes at one end of the top of the sleeve are overlaid with magnets 82 of a suitable strength to overcome the weight of the rods, i.e. to pull the rods up into the detent holes, thereby locking the box. These magnets are preferably covered by a plastic strip 84 to prevent removal.

Figure 8:
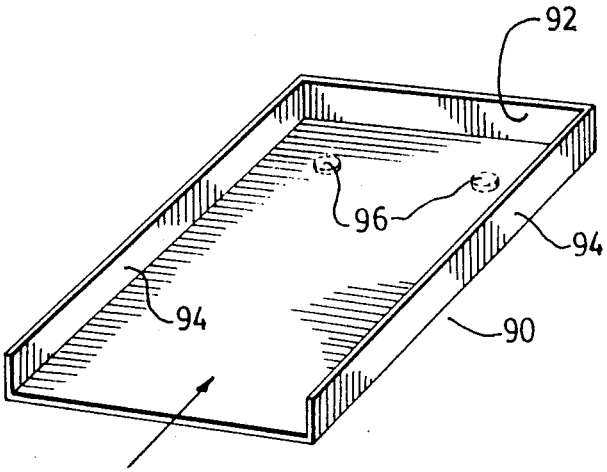
FIG. 8 is a perspective of the decoupler for the lockable box.

Referring to FIG. 8, the release unit 90 is a rectangular platform with a stop wall 92 and two side walls 94 to define a space corresponding to the box shape. Adjacent the stop wall at positions corresponding to the locations of the locking pins are two strong magnets 96. These magnets are sufficiently strong to overcome the force of the magnets 82, or springs if used, so that the locking pins are withdrawn from the detent holes, thus permitting the sleeve to be withdrawn from the tray.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, though only two specific applications are described above, it should be apparent that the locking mechanism could be employed in a wide variety of specific applications and structures, not necessarily limited to the field of retail merchandising.

The interlocking channel and T-shape could be interchanged. Other interlocking arrangements could be contemplated.

In order to make life more difficult for anyone who figures out the principle of operation, additional countermeasures could be added, e.g. multiple locking pins in irregular or awkward locations and/or variations of magnetic or spring strength. For example, the system could be set up to require the use of a magnet which is much stronger than those readily available to members of the general public.

What is claimed as the invention is:

1. A locking and unlocking system, comprising a locking mechanism for preventing sliding movement between first and second slidably juxtaposed parts, and a decoupling unit, said locking mechanism comprising magnetically actuatable pin means in a blind hole in said first part and a detent opening or recess in said second part, at least a portion of said pin means being magnetically attractable, said pin means being moveable between a first position in which a pin portion of said pin means enters said detent, thereby preventing sliding movement between said first and second parts, and a second position in which said pin portion is retracted into said blind hole from said detent, thereby permitting sliding movement, and means for biasing said pin portion into said first position, said decoupling unit comprising a frame adapted to receive the locked first and second parts and a magnet mounted in said frame adjacent the position of said pin means when said parts are positioned in said frame, so as to attract said pin means to retract it to said second position, thereby permitting sliding decoupling of said first and second parts.

2. A locking and unlocking system as recited in claim 1, further comprising a fake key hole on said locking mechanism and a fake key projecting from said decoupling unit, respectively positioned to align with each other when said locking mechanism is positioned in said decoupling unit.

3. A locking and unlocking system as recited in claim 1, in which said means for biasing said pin portion into said first position comprises a spring between said pin means and said first part.

4. A locking and unlocking system as recited in claim 1, in which said means for biasing said pin portion into said first position comprises a second magnet adjacent said detent opening or recess in said second part, whereby said pin means is magnetically attracted to position said pin in said first position, said second magnet being sufficiently weaker than said magnet in said decoupling unit to permit said decoupling unit magnet to overcome the biasing force produced by said second magnet.

5. A locking kit for a box having a hinged lid, said kit comprising:

an anchoring track strip fastenable along at least a portion of the sidewall of said box remote from said hinge;

a locking chamber slidably engageable with said anchoring track strip, said locking chamber including a flange adapted to overlie at least a portion of said lid, thereby preventing said lid from being opened;

magnetically actuatable pin means in a blind hole in said locking chamber and a detent opening or recess in said anchoring track strip, at least a portion of said pin means being magnetically attractable, said pin means being moveable between a first position in which a pin portion of said pin means enters said detent, thereby preventing sliding movement between said locking chamber and said anchoring track strip, and a second position in which said pin portion is retracted into said blind hole from said detent, thereby permitting sliding movement, and means for biasing said pin portion into said first position.

6. A locking kit as recited in claim 5, in which said means for biasing said pin portion into said first position comprises a spring between said pin means and said first part.

7. A locking kit as recited in claim 5, in which said means for biasing said pin portion into said first position comprises a magnet adjacent said detent opening or recess in said second part, whereby said pin means is magnetically attracted to position said pin in said first position.

8. A product security system comprising:

a locking mechanism for preventing sliding movement between a slidably juxtaposed product container and product container locking structure; and a decoupling unit, said decoupling unit comprising a frame adapted to receive said slideably juxtaposed parts and means within said frame adapted to disengage said locking mechanism, thereby permitting sliding decoupling of said juxtaposed parts.

9. A product security system as recited in claim 8, further comprising a fake key hole on said locking mechanism and a fake key projecting from said decoupling unit, respectively positioned to align with each other when said slidably juxtaposed parts are positioned in said decoupling unit.

10. A product security system as recited in claim 8, in which said locking mechanism comprises magnetically actuatable pin means in a blind hole in said locking structure and a detent opening or recess in said product container, at least a portion of said pin means being magnetically attractable, said pin means being moveable between a first position in which a pin portion of said pin means enters said detent, thereby preventing sliding movement between said container and said locking structure, and a second position in which said pin portion is retracted into said blind hole from said detent, thereby permitting sliding movement, and means for biasing said pin portion into said first position.

11. A product security system as recited in claim 10, in which said means within said frame adapted to disengage said locking mechanism comprises a magnet mounted in said frame adjacent the position of said pin means when said product container and locking structure are positioned in said decoupling unit, so as to attract said pin means to retract it to said second position.

12. A product security system as recited in claim 11, in which said means for biasing said pin portion into said first position comprises a second magnet adjacent said detent opening or recess in said product container, whereby said pin means is magnetically attracted to position said pin in said first position, said second magnet being sufficiently weaker than said magnet in said decoupling unit to permit said decoupling unit magnet to overcome the biasing force produced by said second magnet.

13. A product security system as recited in claim 8, in which said product container comprises a display box having an open top and a locking unit fastened to one end of said box, and in which said product container locking structure comprises a sleeve slidable over said box to cover said open top, said sleeve including structural means contacting the underside of the box such that the sleeve can only be applied and removed by sliding in the plane of the box, said sleeve including at least one detent recess, said locking unit including magnetically actuatable pin means in a blind hole in said locking unit at a location aligning with the location of said detent recess when said sleeve is positioned over said box, at least a portion of said pin means being magnetically attractable, said pin means being moveable between a first position in which a pin portion of said pin means enters said detent, thereby preventing sliding movement between said box and said sleeve, and a second position in which said pin portion is retracted into said blind hole from said detent, thereby permitting sliding movement, said product container further comprising means for biasing said pin portion into said first position.

14. A product security system as recited in claim 13, in which said decoupling unit comprises a tray adapted to receive said product container, said tray having imbedded therein at lest one magnet, there being a magnet at a position aligning with each respective magnetically actuatable pin means in said product container when said product container is positioned in said tray, whereby each said magnet can retract its respective pin means to unlock said sleeve from said box.

15. A product security system as recited in claim 14, further comprising guide means in said tray to ensure proper positioning of said product container.

* * * * *